US007036284B1

(12) United States Patent
Larson

(10) Patent No.: US 7,036,284 B1
(45) Date of Patent: May 2, 2006

(54) STUCCO CASING BEAD

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 307 days.

(21) Appl. No.: 10/163,978

(22) Filed: Jun. 6, 2002

(51) Int. Cl.
*E04B 9/00* (2006.01)

(52) U.S. Cl. ..... 52/506.1; 52/202; 52/408

(58) Field of Classification Search ..... 52/506.01, 52/235, 716.1, 256, 257, 454, 202, 408
See application file for complete search history.

(56) References Cited

U.S. PATENT DOCUMENTS 1,310,331 A * 7/1919 Ficklen ..... 404/8
2,679,156 A * 5/1954 McFarland ..... 52/371
2,904,992 A * 9/1959 Cruser ..... 52/256
3,568,391 A * 3/1971 Conway ..... 52/733.4
3,672,108 A * 6/1972 Conway ..... 52/367
4,531,335 A * 7/1985 Mangan ..... 52/208
4,590,733 A * 5/1986 Schneller et al. ..... 52/745.13
4,646,498 A * 3/1987 Schneller et al. ..... 52/309.12
5,003,743 A * 4/1991 Bifano et al. ..... 52/288.1
5,022,212 A * 6/1991 Lippolt ..... 52/222
5,410,852 A * 5/1995 Edgar et al. ..... 52/408
5,442,886 A * 8/1995 Iacobelli ..... 52/255
5,519,969 A * 5/1996 Golba ..... 52/60
5,531,051 A * 7/1996 Chenier et al. ..... 52/255
5,673,529 A * 10/1997 Treister et al. ..... 52/511
5,845,441 A * 12/1998 Swartz ..... 52/250
5,937,600 A * 8/1999 Larson ..... 52/302.6
5,966,885 A * 10/1999 Chatelain ..... 52/309.4
5,987,835 A * 11/1999 Santarossa ..... 52/417
6,293,064 B1 * 9/2001 Larson ..... 52/302.1
6,298,609 B1 * 10/2001 Bifano et al. ..... 52/58
6,332,599 B1 * 12/2001 Spartz ..... 249/34
6,470,638 B1 * 10/2002 Larson ..... 52/302.1
6,519,904 B1 * 2/2003 Phillips ..... 52/309.12
6,526,714 B1 * 3/2003 Billings et al. ..... 52/309.8
6,698,144 B1 * 3/2004 Larson ..... 52/202

* cited by examiner

*Primary Examiner*—Ramon O Ramirez

(57) ABSTRACT

An improved curtain wall casing bead for installation on buildings having stucco or similar curtain wall exteriors. The improved curtain wall casing bead incorporates a mesh attached to at least the base portion of the casing or starter bead, which mesh extends beyond the front edge of the base, and, when folded upward over the face of an inserted foam or curtain wall panel, provides additional area for the infiltration of over-applied stucco finishes or the like. Such additional infiltration, after drying of the over-applied layer provides a more adherent, higher quality and more durable attachment of the stucco finish to the casing bead and the overall wall structure is achieved.

5 Claims, 2 Drawing Sheets

STUCCO CASING BEAD

The present invention relates to an improved casing bead for the installation of exterior curtain wall or stucco siding and the like and more particularly to such a casing bead that incorporates an attached mesh structure for more secure installation and application of over-applied stucco finishes.

BACKGROUND OF THE INVENTION

The term curtain wall refers to a type of building construction in which an exterior non-load-bearing wall is supported in front of the structural frame like a curtain. U.S. Pat. No. 5,937,600 describes a casing bead or starter track for the installation of stucco-covered, curtain wall type, foamed siding applied to the exterior of buildings prior to the application of an over-applied coating of a stucco finish or the like. The device described in this patent comprises a generally U-shaped channel and incorporates in its front wall apertures for the infiltration of caulk, stucco or the like during erection and in its rear wall striations that serve to grip an inserted foam panel and any included caulking or the like.

While the casing bead as just described offers enhanced resistance to moisture infiltration as well as security of installation, there remains a continuing desire to improve the adhesion of the over-applied stucco finish to the casing or starter bead as described in this U.S. Patent. Thus, while infiltration of the over-applied stucco into the apertures in the front wall of the prior art casing bead channel provides some adhesion of the over-applied stucco finish, it would be highly desirable if some means could be provided to further improve the adhesion of the over-applied stucco finish to the casing or starter bead to improve the overall quality and durability of the installation.

OBJECT OF THE INVENTION

It is therefore an object of the present invention to provide an improved casing bead for installation on buildings utilizing a stucco-covered, curtain wall-type construction that demonstrates provides a mechanism for improving the adhesion of an over-applied stucco finish or the like.

SUMMARY OF THE INVENTION

According to the present invention, there is provided an improved casing or starter bead structure for the installation of curtain wall structures of the type described above. This improved casing or starter bead incorporates a mesh attached to at least the base portion of the casing or starter bead, which mesh extends beyond the front edge of the base and provides additional area for the infiltration of over-applied stucco finishes or the like when such mesh is folded upward over the surface of an inserted foam or curtain wall panel. Such additional infiltration, after drying of the over-applied layer provides a more adherent, higher quality and more durable attachment of the stucco finish to the casing bead and the overall wall structure.

DETAILED DESCRIPTION

Figure 1:
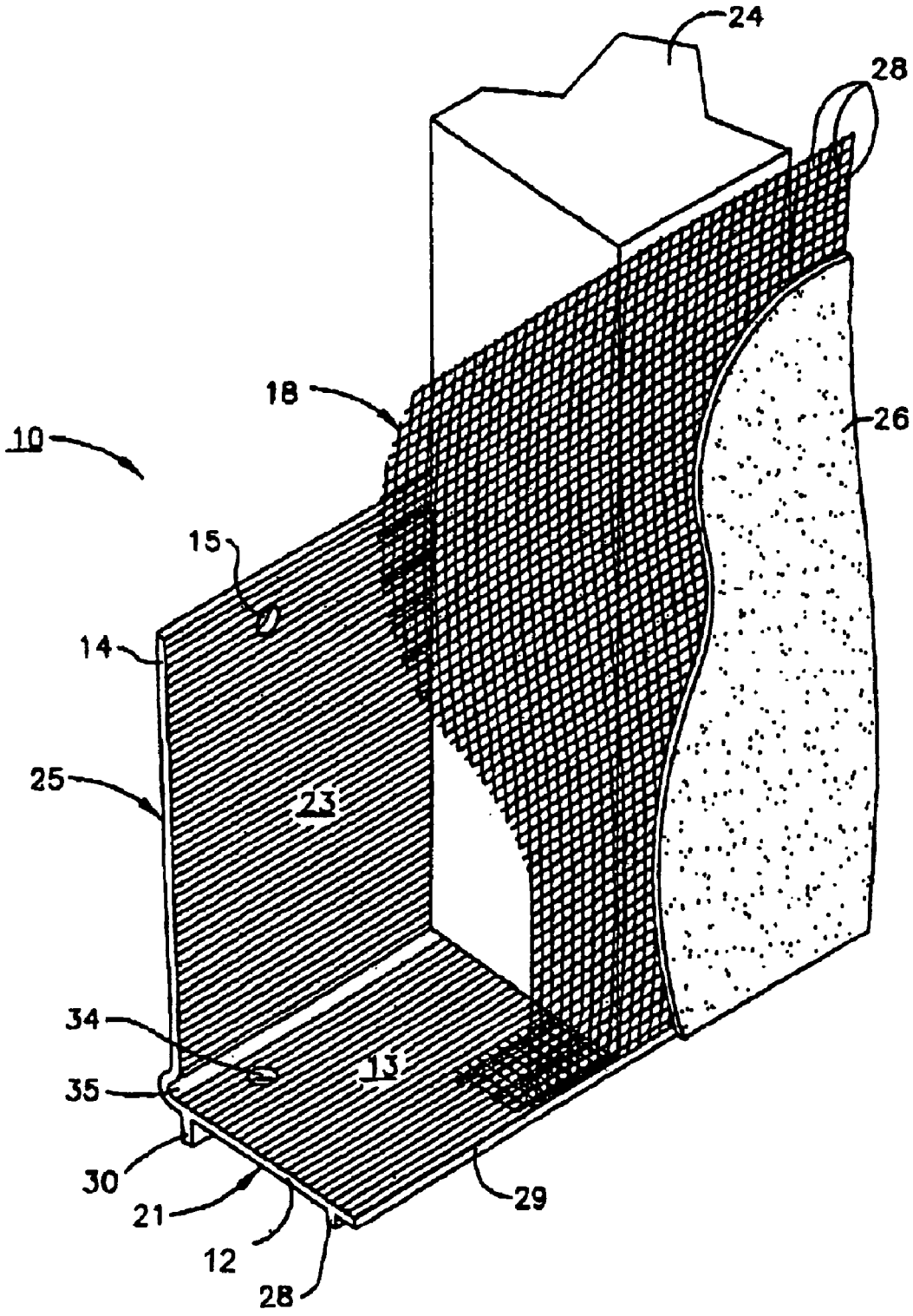
FIG. 1 is a partially cutaway perspective view of the improved casing bead of the present invention showing an inserted foam or curtain wall panel with over-applied stucco finish.

As shown in FIG. 1, the casing bead 10 of the present invention comprises a relatively horizontal base 12, an elongated upright nailing flange 14 (including fastener holes 15) extending vertically from upper surface 13 of horizontal base 12 at an angle of 90° or more and preferably about 95°, and a mesh 18, incorporating openings 28, that is attached to surface 13 of base 12 in the embodiment depicted in FIG. 1. According to an alternative embodiment, mesh 18 may be wrapped about the outside surface 21 of horizontal base 12. Other arrangements such as extension of mesh 18 such that it is attached to upright nailing flange 14, either at front surface 23 or rear surface 25 are also contemplated as long as secure attachment of mesh 18 to the structural member(s) of casing bead 10 is achieved. All surface that might come into contact with finish 26 are preferably striated, as shown for surfaces 13 and 23 in FIG. 1, for improved adhesion. Base 12 also incorporates a series of weep holes 34 spaced at regular intervals (preferably about 6 inches apart) just forward of the line 35 where nailing flange 14 intersects base 12 along its rear edge. According to a highly preferred embodiment, weep holes 34 are located about one half inch forward of the intersection of nailing flange 14 with base 12. While the angle between base 12 and nailing flange 14 along line 35 may be as small as 90°, it is preferred that it be greater than 90° and preferably abut 95° to assure proper drainage of moisture from casing bead 10.

Casing bead 12 also includes a longitudinal stop 40 just behind front edge 29 of base 12. Stop 28 serves as a placement aid in the installation of panels 24 of the type described herein and shown in FIG. 1. It is preferred that stop 28 be located about three sixteenths of an inch from front edge 29.

Mesh 18 may be fabricated from any suitable material such as a polymeric filament, fiberglass etc. or any other suitable material which can be made to adhere or otherwise be attached to the structural surfaces (surfaces 13, 21, 23 and 25) of casing bead 10 to allow secure attachment of stucco or other suitable finish 26 thereto through infiltration of finish 26 through openings 28. According to a specifically preferred embodiment, mesh 18 is fabricated from fiberglass for reasons of cost, availability and strength relative thereto.

The size of openings 28 in mesh 18 is not particularly critical to the successful practice of the present invention, as long as openings 28 are of a size and configuration as to provide adequate improved adhesion of over-applied finish 26 as described herein. A preferred size for openings 28 is about one eighth inch square as this size is easily obtained and provides the required adhesion of finish 26 to curtain wall casing bead 10.

Mesh 18 may be attached to casing bead 10 in any suitable fashion including but not limited to adhesion using an appropriate adhesive, double sided tape, strippable adhesive tape or using more sophisticated techniques such as welding, ultrasonically or otherwise, of mesh 18 to surfaces 13, 21, 23 and 25. Whatever method is used to attach mesh 18 to the structure of casing bead 10, it should be adequate to provide a relatively strong attachment to provide the enhanced bonding quality and durability desired through the use of this unique and novel structure in a curtain wall installation.

Casing bead 10 may be fabricated from any suitable material such as a metal of plastic, however plastic materials such as poly(vinyl) chloride and the like are specifically preferred for reasons of cost and ease of manufacture through extrusion.

Figure 2:
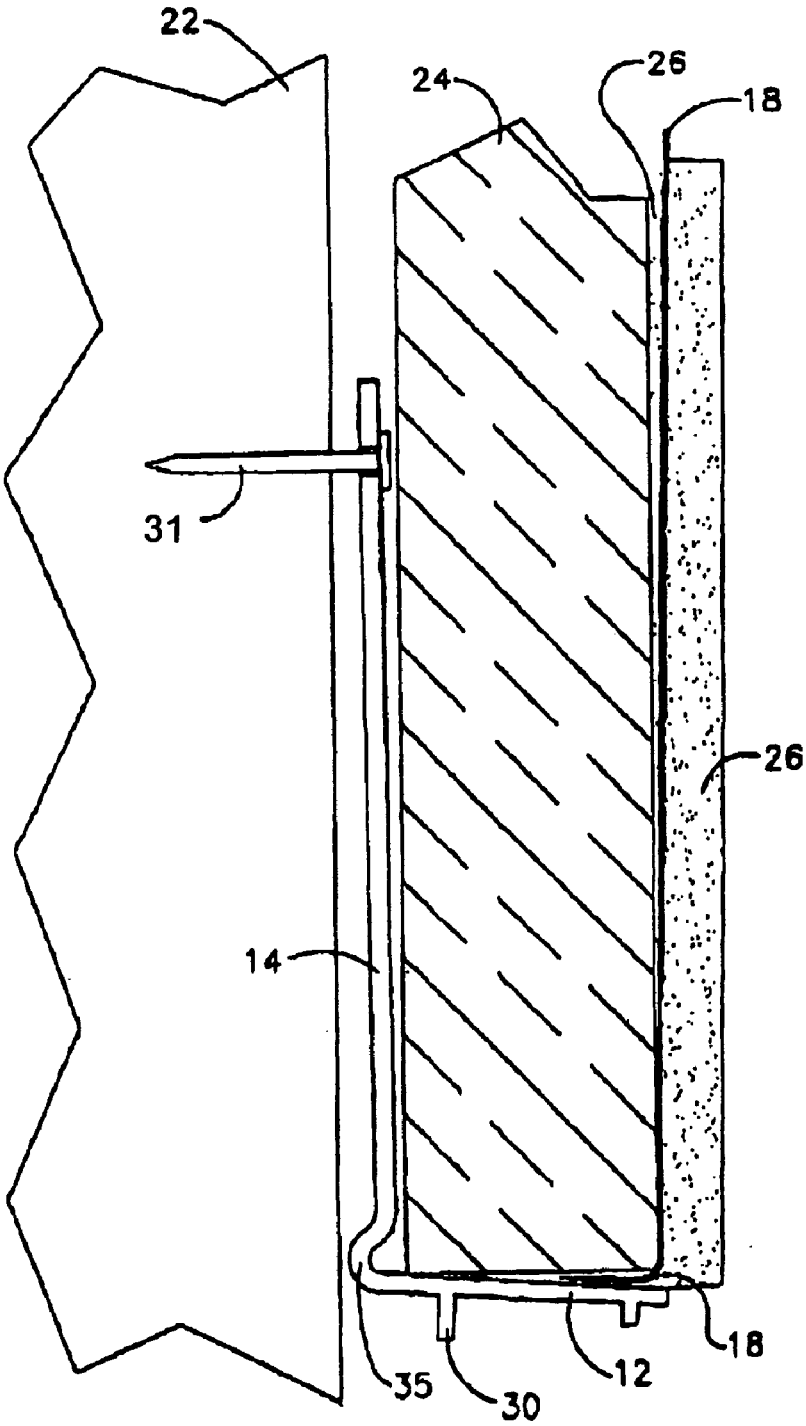
FIG. 2 is a cross-sectional view of the stucco casing bead of the present invention showing the relationship between the wall, the inserted foam, the over-applied stucco finish and the casing bead of the present invention.

FIG. 2 shows casing bead 10 applied to a wall 22 using nails or similar fasteners 23 and including mesh 18, an inserted foamed panel 24 and over-applied stucco or similar finish 26. Stucco or similar finish 26 infiltrates the openings 28 in mesh 18 allowing stucco or similar finish 26 to adhere to foam panel 24 through openings 28 to firmly secure stucco finish 26 to foam panel 24 and in turn to casing bead 10 after finish 26 sets or hardens, thereby providing a virtually monolithic or at least unitized curtain wall structure.

While it is preferred that mesh 18 be co-extensive, i.e. extend along the entire length of base 12, it is, of course, possible to obtain some of the advantages of the use of the structure described herein by locating segments of mesh 18 intermittently along base 12, at either end of base 12 or in any other of numerous possible configurations, and all of such alternative configurations are considered to be within the scope of the preferred embodiments of the present invention. Mesh 18, as shown in the various Figures, should extend beyond front edge 29 of base 12 so as to permit mesh 18 to wrap up and around the face of an inserted curtain wall or foam panel 24 as shown in FIG. 2.

In the prior art casing beads of the type described herein, nailing flange 14 has been relatively short, i.e. less than about 2 inches. This made nailing of the casing bead in place relatively difficult and, while providing adequate protection against moisture permeation due to "blow back" of rain at the junction of the casing bead and the over-applied stucco, in some more aggravated cases, moisture could and did pass over the top of the nailing flange. The casing bead 10 of the present invention utilizes a nailing flange 14 that is between about 3 and 4 inches high and preferably at least 3.5 inches high to simplify the nailing task and to provide added protection against moisture penetration in high wind situations.

Base 12 may be of any appropriate width, but should be such as to engage the foam panel 24 being installed therein. Such materials generally have a thickness of between about ½ of an inch and 1 inch and the width of base 12 between nailing flange 14 and front edge 29 should be such as to accommodate such materials of these dimensions.

According to a particularly preferred embodiment of casing bead 10 of the present invention, casing bead 10 incorporates a longitudinal drip edge 30 that extends from lower surface 21 of base 12 as shown in FIGS. 1 and 2. Drip edge 30 is located just forward of weep holes 34 to permit the removal of any moisture that might infiltrate casing bead 10 under, for example, high wind conditions.

As will be apparent to the skilled artisan, a number of variations and modifications can be made to the structure described above without departing from the spirit and scope of the present invention. All such modifications and variations are clearly contemplated as being within the scope of the appended claims.

What is claimed is:

1. A curtain wall casing bead comprising:

a) a base having front and rear elongated edges and upper and lower surfaces;

b) weep holes in said base proximate said rear elongated surface;

c) a nailing flange extending upward from said base along said rear elongated edge at an angle equal to or greater than about 90° and including inside and outside surfaces;

d) a mesh including openings therein and including a first substantially planar first portion attached to said base, said mesh having a second substantially planar portion extending upwardly from said base and said front elongated edge, such that, said mesh can be folded upward over a curtain wall panel having a front surface inserted into said curtain wall casing bead, such that said mesh is disposed between said front surface and an over-applied layer of material; and e) an integral longitudinal stop extending from said lower base surface proximate said base front edge.

2. The curtain wall casing bead of claim 1 wherein said nailing nange ranges from about 3 to about 4 inches in height.

3. The curtain wall casing bead of claim 1 wherein said mesh is attached to said base upper surface or said base lower surface.

4. The curtain wall casing bead of claim 1 wherein said mesh is attached to said base lower surface and said nailing flange outside surface.

5. The curtain wall casing bead of claim 1 wherein said mesh is attached only intermittently along said base.

* * * * *